US009997147B2

(12) United States Patent
Kasahara

(10) Patent No.: US 9,997,147 B2
(45) Date of Patent: Jun. 12, 2018

(54) MUSICAL INSTRUMENT DIGITAL INTERFACE WITH VOICE NOTE IDENTIFICATIONS

(71) Applicant: Masaaki Kasahara, Sunnyvale, CA (US)

(72) Inventor: Masaaki Kasahara, Sunnyvale, CA (US)

( * ) Notice: Subject to any disclaimer, the term of this patent is extended or adjusted under 35 U.S.C. 154(b) by 0 days. days.

(21) Appl. No.: 15/213,677

(22) Filed: Jul. 19, 2016

(65) Prior Publication Data

US 2017/0025110 A1 Jan. 26, 2017

Related U.S. Application Data

(60) Provisional application No. 62/231,880, filed on Jul. 20, 2015.

(51) Int. Cl.

| | |
|---|---|
| ***G04B 13/00*** | (2006.01) |
| ***A63H 5/00*** | (2006.01) |
| ***G10H 1/00*** | (2006.01) |
| ***G10H 1/20*** | (2006.01) |

(52) U.S. Cl.

CPC ..... *G10H 1/0066* (2013.01); *G10H 1/20* (2013.01); *G10H 2210/561* (2013.01); *G10H 2240/145* (2013.01)

(58) Field of Classification Search

CPC ..... G10H 1/0066; G10H 2240/056; G10H 2240/311; G10H 1/0058; G10H 1/0025; G10H 1/183; G10H 7/00; G10H 2240/145; G10H 2240/021; G10H 2240/125; G10H 2210/395; G09B 15/00; G10G 1/00; G10C 3/12; G10K 15/02; G10K 15/04

See application file for complete search history.

(56) References Cited

U.S. PATENT DOCUMENTS

| | | | | | |
|---|---|---|---|---|---|
| 5,565,641 | A * | 10/1996 | Gruenbaum | G10H 1/0066 | 84/451 |
| 5,650,584 | A * | 7/1997 | Shinsky | G10H 1/0025 | 84/613 |
| 5,783,767 | A * | 7/1998 | Shinsky | G10H 1/0025 | 84/613 |
| 5,792,971 | A * | 8/1998 | Timis | G10H 1/0008 | 369/83 |
| 6,066,794 | A * | 5/2000 | Longo | G10H 1/02 | 84/600 |
| 6,156,965 | A * | 12/2000 | Shinsky | G10H 1/0025 | 84/650 |
| 6,156,966 | A * | 12/2000 | Shinsky | G10H 1/0025 | 84/613 |
| 6,191,349 | B1 * | 2/2001 | Flam | G10H 1/0066 | 84/609 |
| RE37,654 | E * | 4/2002 | Longo | G10H 1/02 | 84/600 |

(Continued)

*Primary Examiner* — Marlon Fletcher

(57) ABSTRACT

A method for generating voice identifications for MIDI (Musical Instrument Digital Interface) note signals. The method provides voice identification for every note in MIDI signals, which makes music learning intuitive and easier. The method can be used with any MIDI instruments as a separate unit, or a part of such instruments. Solfege is used as voice identification system since it is widely used in music education. However, any such system can be used or newly devised by preparing a different set of patches.

9 Claims, 1 Drawing Sheet

(56) References Cited

U.S. PATENT DOCUMENTS

| | | | | |
|---|---|---|---|---|
| 6,372,975 | B1 * | 4/2002 | Shinsky | G10H 1/0025 84/612 |
| 6,441,289 | B1 * | 8/2002 | Shinsky | G10H 1/0025 84/464 R |
| 6,448,486 | B1 * | 9/2002 | Shinsky | G10H 1/0025 84/613 |
| 7,176,373 | B1 * | 2/2007 | Longo | G10H 1/0066 84/600 |
| 2003/0110929 | A1 * | 6/2003 | Riopelle | G10H 1/00 84/615 |
| 2004/0206226 | A1 * | 10/2004 | Negoescu | G10H 7/006 84/600 |
| 2006/0027078 | A1 * | 2/2006 | Kawashima | G10H 1/0066 84/609 |
| 2008/0184872 | A1 * | 8/2008 | Hunt | G10H 1/0075 84/645 |
| 2009/0205480 | A1 * | 8/2009 | Kulkarni | G10H 1/0075 84/609 |
| 2009/0205481 | A1 * | 8/2009 | Kulkarni | G10H 1/0075 84/609 |
| 2015/0268926 | A1 * | 9/2015 | Panaiotis | G06F 3/167 715/716 |
| 2017/0025110 | A1 * | 1/2017 | Kasahara | G10H 1/0066 |
| 2017/0032775 | A1 * | 2/2017 | Schlessinger | G10H 3/146 |

* cited by examiner

MUSICAL INSTRUMENT DIGITAL INTERFACE WITH VOICE NOTE IDENTIFICATIONS

CROSS-REFERENCE TO RELATED APPLICATIONS

This application claims the benefit of provisional patent application U.S. No. 62/231,880 filed Jul. 20, 2015 by the present inventor.

SPECIFICATION

Field of the Invention

The present invention relates generally to digital interfaces for musical instruments, and specifically to methods and devices for representing musical notes using a digital interface.

Background of the Invention

MIDI (Musical Instrument Digital Interface) is a standard known in the art that enables digital musical instruments and processors of digital music, such as personal computers and sequencers, to communicate data about musical notes, tones, etc. Information regarding the details of the MIDI standard is widely available.

MIDI files and MIDI devices which process MIDI information designate a desired simulated musical instrument to play forthcoming notes by indicating a patch number corresponding to the instrument. Such patch numbers are specified by the GM (General MIDI) protocol, which is a standard widely known and accepted in the art.

According to GM, 128 sounds, including standard instruments, voice, and sound effects, are given respective fixed patch numbers, e.g., Acoustic Grand Piano=1. When any one of these patches is selected, that patch will produce qualitatively the same type of sound, from the point of view of human auditory perception, for any one key on the keyboard of the digital musical instrument as for any other key varying essentially only in pitch.

MIDI allows information governing the performance of 16 independent simulated instruments to be transmitted simultaneously through 16 logical channels defined by the MIDI standard. Of these channels, Channel 10 is uniquely defined as a percussion channel, which has qualitatively distinct sounds defined for each successive key on the keyboard, in contrast to the patches described hereinabove.

In modern western music, we employ so-called equal temperament tuning system where we divide one octave into 12 equally divided pitches. We use terms such as C, C#/D flat, . . . , B to indicate which one of the 12 pitches we mean. In every octave, we observe the repeat of the same sequence.

We also have a Solfege syllable assigned to each pitch name described hereinabove. For example, Do is used to indicate C. All Solfege syllables correspond to C notes sound qualitatively the same except for the feeling of higher/lower registers.

We use Solfege in music education because it enables us to sing a tune with pitch information. In theory, it is possible to use pitch names, such as C, D, etc. In practice, however, it is inconvenient to employ longer syllables for fast passages.

There are actually two kinds of Solfege in use today. One is called Fixed Do System, and the other Movable Do System. As the names suggest, you do not move the starting point Do in Fixed Do System whereas you move the starting point Do, sometimes called root note, in Movable Do System according to the key you are in.

BACKGROUND

Prior Art

Adding Solfege to digital musical instruments is not a new idea. U.S. Pat. No. 4,733,591 shows such an attempt in early days. More recently, U.S. Pat. No. 6,191,349 shows a method utilizing MIDI and wavetable synthesizers to add Solfege and/or human voice to MIDI instruments. The most important benefit of the method is that it requires no modification to the hardware. You only need a specially prepared patch. However, if you try it, you will discover the following two shortcomings. It does not support Movable Do System, which is the most widely used Solfege convention in the United States. It gives you a feel of the latency, which is the time between your pressing a key and actually hearing the corresponding sound. This is due to the nature of the human voice. Solfege syllables have consonant and vowel parts. It takes time to mature the sound, reaching the full vowel part, which is the cause of the problem.

SUMMARY OF THE INVENTION

It is an object of some aspects of the present invention to provide improved devices and methods for utilizing digital music processing hardware.

It is an object of some aspects of the present invention to provide devices and methods for generating voice identifications with digital music processing hardware.

DETAILED DESCRIPTION OF THE INVENTION

Figure 1:
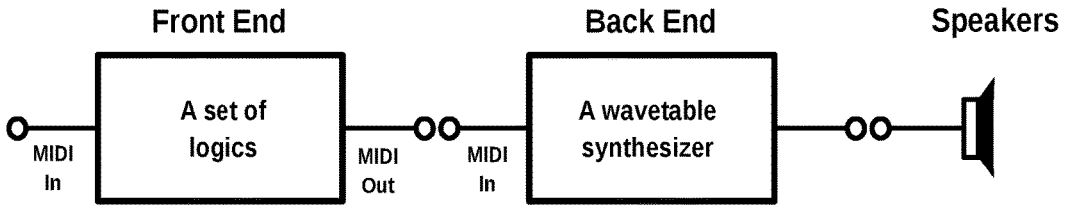
FIG. 1 is a block diagram of the preferred embodiment.

The preferred embodiment is probably the easiest way to implement the invention with the current wavetable based synthesizer system. It consists of two components as in FIG. 1: a front end and a back end. The front end is a set of logics which generate additional MIDI signals for voice identifications. Every incoming MIDI note (on/off) signal generates one additional MIDI note signal to drive a special set of patches prepared at the back end for voice note identifications. The original MIDI signals as well as the additional MIDI signals generated at the front end are sent to the back end. Note: Typically, logical channel 1 is used for the original MIDI signals. The rest of the discussion assumes that is the case.

Figure 2:
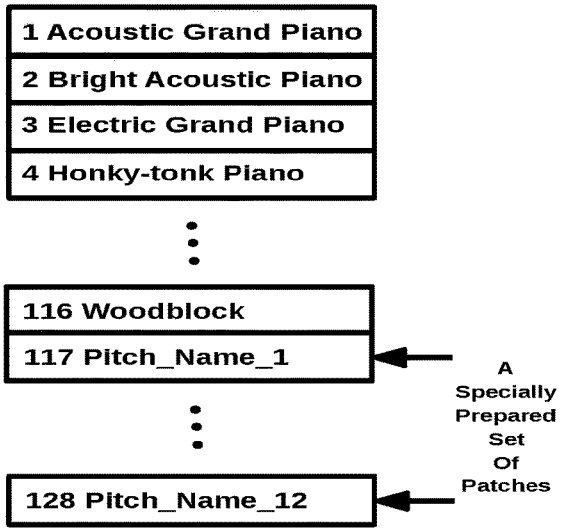
FIG. 2 is a configuration of the Standard Patch Area, including a set of specially prepared patches

The back end is a regular MIDI synthesizer, which contains the special set of patches used with the additional MIDI signals generated at the front end logic. The special set of patches occupies a part of the standard patch area where other instrumental patches normally reside as in FIG. 2. Due to this, those patch numbers reserved for the special set of patches are not available under GM. The MIDI synthesizer can be either hardware or software.

The front end can be bypassed, when not needed, so that the back end can function as a regular MIDI synthesizer. When the front end is turned on, it will make the whole system into one instrument synthesizer with voice note identifications. Users can change the instrument at any moment. This is useful for daily practice routines. Strictly speaking, there are two more channels for instruments and one for percussion available during this operation.

It is also possible to integrate the functionality of the front end into the back end, a synthesizer itself. This is especially an attractive option for software based synthesizers where such integrations can be done easily. This embodiment is functionally equivalent to the preferred embodiment. As such, it will be treated as the preferred embodiment.

There is yet another embodiment where the front end logic is implemented into any of the channels available in a target synthesizer with additional supporting synthesizers for voice note identifications. For example, MIDI specifies 16 logical channels. In this embodiment, every channel except for the percussion channel can be equipped with the invention. It is also possible to set up a separate set of patches used for the logic apart from the regular patch area. This way, it is possible to add the functionality of the invention onto any available MIDI channels without changing the original specifications of the target synthesizer.

In short, the preferred embodiment is created to implement the invention without any changes to the present wavetable synthesizer except for the changes to the original patch set, which is configurable in general. On the other hand, this embodiment requires fairly large modifications to the synthesizer itself including additional patch area. Each logical channel will look like the combination of the front end and the backend of the preferred embodiment with the special set of patches occupying a new area. In fact, it should work that way.

Usually, the available CPU power for the target synthesizer dictates how many channels can be equipped with the invention. For example, users can select up to 5 channels with it and the remaining channels without it. Please note that the voice identifications have a limit as to how many channels can be used simultaneously with voice identifications on. This limitation comes from our auditory ability.

Practically, 5 (channel) is a good number since there is a genre of music called 5 Part Fugue where each part is assigned to a channel. 4 is another good number because there is a genre of music called 4 Part Choir or 4 Part Fugue. If you add proper panning for each channel, it will be usable up to 4 or 5. Beyond that number, it is debatable, but the concept remains exactly the same. In short, this embodiment is a comprehensive use of the invention for more challenging music settings. It should be useful for choir/ensemble practices.

The preferred embodiment is the conceptual basis for more complex applications of the invention.

The role of the front end is to generate one additional MIDI note signal which provides voice note identification for a given MIDI note signal. The original signal is sent to the back end unchanged to produce simulated sound of a subject instrument for a selected patch number. At the same time, the additional MIDI note signal is sent to the back end to produce a proper pitch name in voice at the pitch frequency of the given MIDI note signal.

To understand this correctly, the structure of the specially prepared set of patches needs to be understood. Every one of the specially prepared set of patches looks exactly like a patch known in the art. For example, when Solfege is used as voice identification system, Do patch for C generates Do sound at a specified MIDI note frequency just like any instrument patch known in the art. However, Do or C appears once in every 12 notes. That is the reason we need a set of 12 patches to cover all the 12 notes in an octave.

Here is how to achieve the front end (a set of logics) in programming. Since we have a set of 12 patches, we need 12 logical channels. For the sake of brevity, we use the following terms: p1 (Channel p1 for Pitch_Name_1), p2, . . . , p12 We also need to use a modulo operator: %. In computing, the modulo operation finds the remainder after division of one number by another.

$$\text{modulo}=\text{MIDI_note_number} \% 12 \quad \text{(Eq. 1)}$$

Let us take the middle C note, for example. It corresponds to MIDI_note_number: 60. In the equation 1 (Eq. 1), the modulo is 0 since the reminder after division of 60 by 12 is 0. The following is a list of all the cases:

If the modulo is 0, send an additional signal to p1.
If the modulo is 1, send an additional signal to p2.
If the modulo is 2, send an additional signal to p3.
If the modulo is 3, send an additional signal to p4.
If the modulo is 4, send an additional signal to p5.
If the modulo is 5, send an additional signal to p6.
If the modulo is 6, send an additional signal to p7.
If the modulo is 7, send an additional signal to p8.
If the modulo is 8, send an additional signal to p9.
If the modulo is 9, send an additional signal to p10.
If the modulo is 10, send an additional signal to p11.
If the modulo is 11, send an additional signal to p12.

The difference between the original signal and the generated signal is the channel number only. The front end checks every incoming MIDI signal. If it is a MIDI note signal, find out the corresponding channel number by the method above, modify the channel number accordingly and send that signal along with the original signal. The process continues indefinitely while the front end logic is turned on.

There is a start-up sequence at the beginning, which sets up p1, . . . , p12 to actual logic channels with a proper patch number. The front end should generate a sequence of MIDI program change signals to configure the back end (synthesizer) as follows:

Set Pitch_Name_1 Patch for Channel p1.
Set Pitch_Name_2 Patch for Channel p2.
Set Pitch_Name_3 Patch for Channel p3.
Set Pitch_Name_4 Patch for Channel p4.
Set Pitch_Name_5 Patch for Channel p5.
Set Pitch_Name_6 Patch for Channel p6.
Set Pitch_Name_7 Patch for Channel p7.
Set Pitch_Name_8 Patch for Channel p8.
Set Pitch_Name_9 Patch for Channel p9.
Set Pitch_Name_10 Patch for Channel p10.
Set Pitch_Name_11 Patch for Channel p11.
Set Pitch_Name_12 Patch for Channel p12.

For example, Pitch_Name_1 is Do when Solfege is used as voice identification system. However, Solfege is not the only option for voice identifications. It is a widely used convention in music education. Any such system can be used with the invention, or even new system can be devised by preparing a different set of patches.

Please note that you need to use actual logical numbers for p1, p2, . . . , p12. Typically, logical number 1 is a default channel for a user selected instrument, as mentioned earlier, and logical number 10 is used as a percussion channel. The remaining 14 channels are available for your selections. Generally, it is easier to use continuous numbers for your programming.

Here are some minor details: The front end should pass a program change command unchanged for the logical channel 1 (used for the user selected instrument) when such a command is detected. This allows users to change the current instrument to a new instrument. Program change commands for the logical channels used for the special patch set should be ignored to preserve the configuration performed at the start-up sequence while the front end is turned on.

The system described up to this point only works with Fixed (Do) System. In order to make the system capable of Movable (Do) System, a new integer variable, key, is introduced. By simply replacing the original equation (Eq. 1) with the following equation (Eq. 2), it is possible to shift the root note.

$$\text{modulo}=(\text{MIDI_note_number}-\text{key})\ \%12 \qquad \text{(Eq. 2)}$$

The value of key should be between 0 and 11. The root note can be chosen among any one of 12 keys. For example, using 0 for key, the root note is C, which is the same as Fixed (Do) System. Using 1 makes it C#/D flat. You can shift the key all the way to 11, which is B, by the way. The value of key can be changed through the user interface or special MIDI commands created for this operation.

What is claimed is:

1. A method for electronic generation of sounds, based on notes in a musical scale, comprising:

assigning respective sounds to said notes, such that each sound is perceived by a listener as qualitatively distinct from a sound assigned to an adjoining note in said musical scale;

preparing an additional multiple of logical channels of a MIDI synthesizer with patches which generate qualitatively distinct sounds;

preparing a set of logics in front of said logical channels, which finds Channel_Number by subtracting a variable from a MIDI note number of a MIDI note signal in said input, then taking a modulo by 12 while using 0 for C, 1 for C#/D flat, 2 for D, 3 for D#/E flat, 4 for E, 5 for F, 6 for F#/G flat, 7 for G, 8 for G#/A flat, 9 for A, 10 for A#/B flat and 11 for B as said variable;

sending said MIDI note signal to a logical channel indicated by said Channel_Number while 0 for a channel loaded with C Patch Set, 1 with C#/D flat Patch Set, 2 with D Patch Set, 3 with D#/E flat Patch Set, 4 with E Patch Set, 5 with F Patch Set, 6 with F#/G flat Patch Set, 7 with G Patch Set, 8 with G#/A flat Patch Set, 9 with A Patch Set, 10 with A#/B flat Patch Set and 11 with B Patch Set;

whereby utilizing Solfege for the patches, a position of Do is changeable to support a Movable Do System in use today;

receiving an input indicative of a sequence of said notes, chosen from among said notes in said musical scale; and generating an output responsive to said sequence of received said notes, in which said qualitatively distinct sounds are produced responsive to respective notes in said sequence at respective musical pitches associated with said respective notes by feeding said input to said set of logics.

2. A method according to claim 1, wherein at least one of said qualitatively distinct sounds comprises a representation of a human voice.

3. A method according to claim 2, wherein said qualitatively distinct sounds comprise solfege syllables respectively associated with said notes, or newly created syllables respectively associated with said notes.

4. A method according to claim 1, wherein said creating of said patches comprise:

generating a digital representation of said sounds by digitally sampling said qualitatively distinct sounds; and saving said digital representation in said patches.

5. A method according to claim 1, wherein said receiving said input comprises playing said sequence of notes on a musical instrument.

6. A method according to claim 1, wherein said receiving said input comprises retrieving said sequence of notes from a file.

7. A method according to claim 6, wherein said retrieving comprises accessing a network and downloading said file from a remote computer.

8. A method according to claim 1 wherein said qualitatively distinct sounds comprise sounds which differ from each other based on a characteristic that is not inherent in a pitch of each of said sounds.

9. A method according to claim 1, wherein said set of logics can have a through output, which can be connected to a separate synthesizer to produce instrumental sound, which can be turned on or off.

* * * * *